United States Patent [19]

Petersen

[11] Patent Number: 5,056,385

[45] Date of Patent: Oct. 15, 1991

[54] COMPOUND TOGGLE LINK

[75] Inventor: Ralph Petersen, DeWitt, Nebr.

[73] Assignee: Petersen Manufacturing Co., Inc., DeWitt, Nebr.

[21] Appl. No.: 516,153

[22] Filed: Apr. 30, 1990

[51] Int. Cl.[5] ..... B25B 7/12

[52] U.S. Cl. ..... 81/370; 81/377; 81/380; 81/367

[58] Field of Search ..... 81/367–384

[56] References Cited

U.S. PATENT DOCUMENTS

| | | | |
|---|---|---|---|
| 2,838,973 | 6/1958 | Petersen | 81/370 |
| 2,853,910 | 9/1958 | Petersen | 81/372 X |
| 3,208,319 | 9/1965 | Westby et al. | 81/367 |
| 3,354,759 | 11/1967 | Cook | 81/379 |
| 4,709,601 | 12/1987 | Petersen | 81/367 |

*Primary Examiner*—D. S. Meislin

*Attorney, Agent, or Firm*—Lackenbach Siegel Marzullo & Aronson

[57] ABSTRACT

A quick release for a conventional plier-type, toggle-locking hand tool comprises a compound toggle link. The new link is pivotably mounted between the movable handle and the conventional toggle member. Four pivot points rather than the usual three form the "power line" of the tool. Locking the tool involves pushing the two internal pivot points inwardly across the power line. Release involves opening the handles which moves the internal pivot points back across the power line. Depending on the dimensions of the actual hand tool, the mechanical advantage of the novel compound link is between 4 to 16.

12 Claims, 1 Drawing Sheet

COMPOUND TOGGLE LINK

FIELD OF THE INVENTION

This invention relates to release mechanisms for toggle-locking hand tools of the pliers type. More specifically, it relates to compound linkages for locking and releasing hand tools used for clinching onto various workpieces and remaining locked thereto without being held continuously by the worker.

BACKGROUND OF THE INVENTION

Pliers-type hand tools with toggle-locking mechanisms are generally known as toggle wrenches or locking pliers. These tools usually comprise a fixed handle with a fixed jaw on one end and a movable jaw with a movable handle. The jaws may be shaped to function as long nose pliers, ordinary wrenches with curved serrated jaws, jaws in the shape of C-clamps, C-clamps with swivel pads, hole punches, or any other kind of hand tool where the toggle-locking action is useful.

These hand tools are so constructed that once the movable jaw is adjusted to seize a workpiece firmly between the movable and the fixed jaw and then the handles are tightly compressed, the toggle mechanism locks the hand tool onto the workpiece. Thereafter the hand may be withdrawn, yet the tool will remain firmly locked in place. This clamping action often requires much force. Frequently, the tool is misadjusted when being clamped, so that it is extremely difficult to release the locked tool. Sometimes it takes as much applied force to open a toggle-locking hand tool as to clamp it onto the workpiece. Tool adjustments are generally made by turning an adjusting screw engaging the fixed handle and modifying physical dimensions in the toggle mechanism.

Oftentimes, a locking hand tool is used in such a confined work space that once it is locked on the workpiece in a compressive motion, there is not enough room for two hands to force it open. Also forcing open a locking hand tool may result in a springing action, which may take the worker unaware, and can cause abrasion or mild injuries to the hands by pushing the hands against adjacent objects. For all these reasons, it is useful to install quick release mechanisms on locking hand tools of the toggle type.

In a conventional locking hand tool, there are three pivot points in what is known as the "power line" from the pivot point of the movable handle on the movable jaw down through an inner pivot near the end of the spanning toggle link. The other end of the toggle link rests pivotably at the tip of the adjusting screw in the channel of the fixed handle. Locking the handle causes the center pivot point to cross the "power line" between the two outer pivots. Unlocking the conventional locking hand tool involves forcing the single center pivot back across the "power line". Usually, this is carried out by means of a release lever pivotably mounted in the channel of the movable handle. The release lever is pushed against a projection on the toggle link, thus causing the toggle link to pivot outward and drive the two handles apart to release the clamping action of the jaws.

DISCUSSION OF THE PRIOR ART

In the past, a variety of approaches have been disclosed in attempting to solve the problem of releasing a locking hand tool with minimal force in a limited physical space, using a reliable mechanism which is capable of being mass produced at low cost and which will survive literally hundreds of thousands of repetitive trials in tests for quality control. Until the present invention, the goals just enumerated have not been met.

A fixed, non-adjustable link opens up the power line locking three fixed pivots and a sliding pivot in a slot in a toggle wrench disclosed by Ward et al. in U.S. Pat. No. 2,503,783. A threaded adjusting nut is perpendicular to the "upper" link, closest to the jaws, functioning as a stop. Release is effectuated by pushing the movable handle away, thus moving the sliding pivot in its slot.

Eisenberg in U.S. Pat. No. 2,576,286 discloses a quick release attachment actuated by the users thumb in the form of a cam on the outside of the movable handle. Turning the outboard cam presses twin shoes on the movable handle against the fixed handle, thus snapping the toggle lock open.

Another rotating cam mounted on a movable handle on the movable jaw pushes against the fixed handle to unlock a toggle wrench in a disclosure by Burns in U.S. Pat. No. 2,590,750.

A releasing lever on the outside of the movable handle fits through a slot in the channel to press the toggle out thus releasing the wrench in U.S. Pat. No. 2,604,803 granted to McCann.

Blatt discloses an intermediate trigger handle with a cam at its end to release a toggle clamp in U.S. Pat. No. 2,783,797.

W. Petersen provides a release lever pushing against a pin in a transverse slot to push a lug in the channel of a movable handle to open a toggle wrench in U.S. Pat. No. 2,838,973.

An intermediate release lever shaped as a cam pushes against the opposing handle to trigger release of a toggle clamp in U.S. Pat. No. 2,937,677 issued to McIlwain.

Westby et al. disclose a toggle member broken up into a multiplicity of compressible links and a travel block in U.S. Pat. No. 3,208,319. A cam is pushed against one of the links to release the toggle action, which is moderated by a biasing spring.

Klenk in U.S. Pat. No. 3,261,073 teaches a plurality of sequential toggle links between two movable handles. Pressing against a coil spring, pushes cams against both handles to open the clamped hand tool.

An asymmetrical curved cam shoe, at the end of one link of an over-center mechanism, releases the linkage with only minimal applied force in U.S. Pat. No. 3,575,064 to Stevinson.

Other U.S. patents in the field of locking hand tools which may be of interest are:

| Inventor | U.S. Pat. No. |
|---|---|
| W. Petersen | 1,489,458 |
| W. Petersen | 2,201,918 |
| W. Petersen | 2,280,005 |
| Borchers | 2,299,454 |
| Toernberg | 2,341,489 |
| W. Petersen | 2,417,013 |
| C. Petersen | 2,563,267 |
| C. Petersen | 2,590,031 |
| W. Petersen | 2,711,663 |
| W. Petersen | 2,853,910 |
| Hostetter | Re. 26,280 |
| C. Petersen et al. | 3,192,804 |
| Schroeder | 3,585,704 |
| Marasco | 3,590,669 |
| Baldwin | 3,600,986 |
| C. Petersen | 4,541,312 |

-continued

| Inventor | U.S. Pat. No. |
|---|---|
| C. Petersen | 4,546,680 |

OBJECTS OF THE INVENTION

It is an object of the present invention to provide a quick release mechanism for toggle-locking hand tools which operates with minimal applied force.

It is a further object of the invention to release toggle-locking hand tools conveniently in a small physical space, preferably by movement of one hand, without any risk of bruising the user by adjacent struts, beams, knobs, bosses, projections, nails, screws, or any other nearby protuberances.

It is yet another object of the invention to provide a mechanism which can be manufactured on a large scale at a reasonable cost.

It is still another object of the invention to provide a reliable mechanism which operates consistently with minimal wear, so that the locking release can be operated hundreds of thousands of times without any chance of failure.

Other objects of the invention will easily be perceived by those skilled in the art.

SUMMARY OF THE INVENTION

These and other objects of the invention are fulfilled by a five-pivot toggle mechanism located between the fixed and movable handles of a toggle-locking hand tool, with a compound toggle linkage mechanism fitting inside the channel of the movable handle. The spanning toggle link is of a conventional design with a transverse projection located near the midpoint. The projection, upon clamping the handles together, fits into the channel of the movable handle acting as a stop to limit closure. The novel aspect of the present invention is an added or second link pivotably mounted totally inside the channel of the movable handle. In the closed locking position, the second or compound link extends from a contact with the projection of the spanning link past the end of the spanning link. The spanning link is pivoted to the compound link. The spanning link further extends to an additional, novel pivot on the movable handle between the pivot point for the spanning link and the conventional pivot point for the movable handle with the movable jaw.

This compound linkage in the toggle mechanism and adding an extra pivot point to that linkage, greatly increases the mechanical advantage of the movable handle. Thus a mere flick outward at the inside end of the movable handle springs the two inner pivot points of what is now a four point "power line" of the locking hand tool back across the "power line", thus unlocking the tool with minimal wear.

In the present invention, there are four pivots in the "power line", the same two outer pivots as described above for the conventional tools, but with an extra pivot in the channel of the compound link, which is itself in the channel of the movable handle. Locking the hand tool of the present invention involves pushing the two inner pivots over center, across the "power line" between the end pivots. Releasing the locking mechanism involves pushing both inner pivot points back across the power line. The compound toggle linkage increases the mechanical advantage and makes the release quicker, easier, and more reliable. The ratio of the length of the movable handle to the distance between the pivot of the movable handle to the pivot of the compound link can range from about 4 to about 16 preferably from about 6 to about 10.

DESCRIPTION OF THE PREFERRED EMBODIMENT

In a conventional locking hand tool of the prior art there are four pivot points around which the parts of the tool rotate in opening and closing the tool. In the oper position, these four pivots outline a trapezoid. In the closed position, these pivots approximate a right triangle. The hypotenuse of this triangle containing three o the pivots is called the "power line". The right angle o the right triangle is the pivot point for the movable jaw The hypotenuse contains the pivot for the movable handle at the movable jaw and the pivot for the toggle link on the movable handle, also on the hypoteneuse is the other end of the toggle link in a pivoting, sliding contact at the end or tip of the adjusting screw in the channel of the fixed handle of the tool. Locking a conventional tool moves the toggle link pivot with the moving handle inwardly slightly across the power line forming the right triangle. Releasing the conventiona tool snaps the toggle link pivot with the moving handle outwardly away from the fixed handle, beyond the former power line.

In the improved tool of the present invention, there are five pivot points forming a pentagon when the too is open and a triangle when the tool is closed. An additional link has been inserted, compared with the prior arts, in the toggle action making it a compound toggle link. Clamping the tool forces the two internal pivots o the pentagon toward the fixed handle across the power line to form the triangle. Releasing the tool clamping action by flicking the end of the movable handle away from the fixed handle, snaps the two internal pivots back across the power line changing the triangle back to its pentagon configuration. The increased mechanica advantage for releasing the tool, is the ratio of the length of the movable handle to the distance between the handle pivot point and the compound link pivo point. The ratio of these two lengths may be from abou 4 to about 16, preferably from about 6 to about 10.

Figure 1:
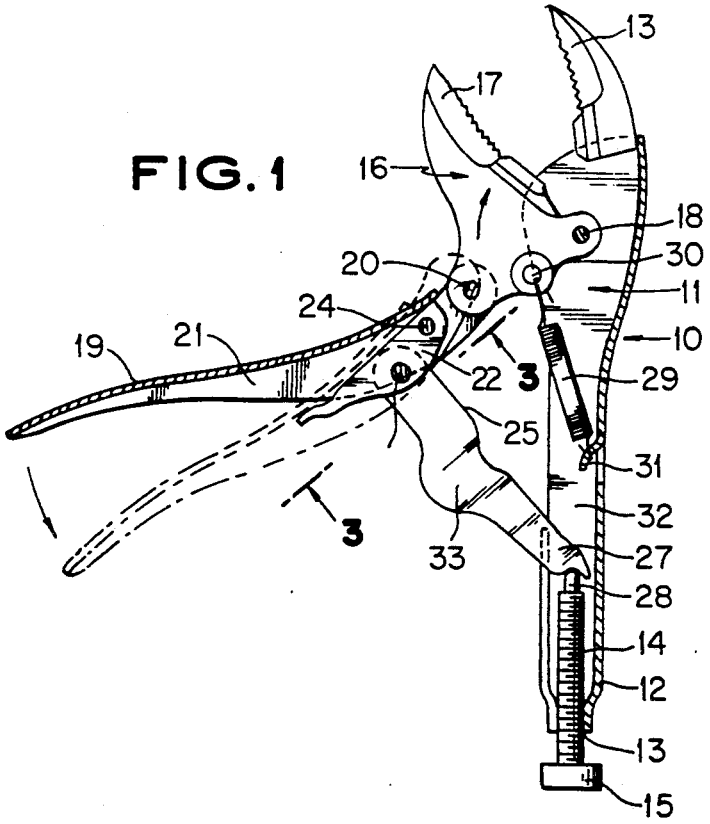
FIG. 1 is a side view of an embodiment of the presen invention in the open, unclamped position.
Figure 2:
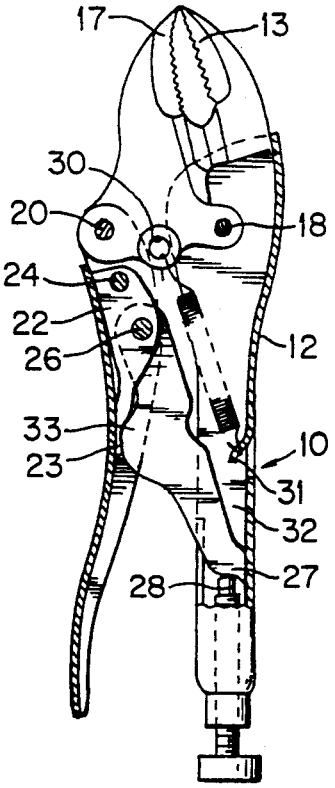
FIG. 2 is a side view of an embodiment of the presen invention in its closed, locked position.
Figure 3:
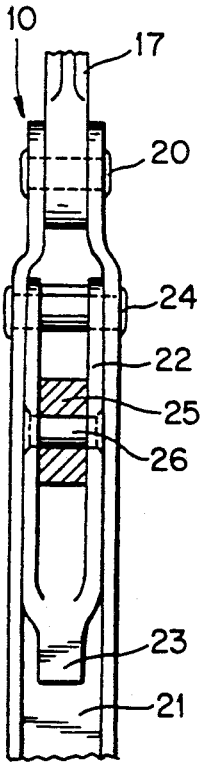
FIG. 3 is a fragmentary view of FIG. 1 taken along the line 3—3.

The tool 10 of FIGS. 1–3 includes a fixed arm 11 having a fixed handle 12 at one end and a fixed jaw 13 at the other end. The jaw 13 is fixedly connected to the handle 12. The handle is formed as a generally U shaped channel. The end of the fixed handle 12, remote from the jaw 13, is completed with a threaded circula aperture 13 through which a threaded screw 14 i threadably engaged. The screw 14 terminates in a knurled adjusting knob 15.

A movable arm 16 includes a movable handle 19 which is formed as a channel, and a movable jaw 1 which is pivotably connected at one end of the movable handle 19 by the pivot pin 20. A pivot pin 18 connects the movable jaw 17 to the fixed handle 12. Within the channel 21 of the movable handle 19, is located the compound link 22 which is also in the form of a U-shaped channel. The compound link 22 is pivotably connected to the movable handle 19 by a pivot pin 24.

A toggle link 25 spans the distance between the fixed handle 12 and the compound link 22 where the toggle link is pivotably connected by the pivot pin 26. The other end 27 of the toggle link 25 is slidably and pivotably engaged with the end 28 of the adjusting screw 14. A projection 33 extends transversely to the length direction of the toggle link 25 and acts as a stop when the jaws are in the closed position by making contact with the end 23 of the compound link 22.

As is apparent from the drawing, turning the adjusting screw 14 changes the distance between the end 27 of the toggle link 25 and the pivot point 18 of the movable jaw 16, whereby the jaws may be adjusted to grip objects of different dimensions without exerting excessive force.

A biasing spring 29 extends between an opening 30 on the movable jaw 16 to a tab 31 protruding within the channel 32 of the fixed handle 12. The spring 29 applies a bias which tends to separate the jaws 13, 17, one from the other.

When the jaw 13, 17 are apart, the five pivots, namely, pivot 18, 20, 24, 26, and the pivoting contact between toggle link 25 at its end 27 with the end of the adjusting screw 14, are arranged as a polygon without distinguishing characteristics. On the other hand, when the jaws are locked together, the pivot points 20, 24, 26 and the pivoting contact 27, 28 are substantially in a straight line, thus forming a right triangle with the other pivot 18. The pins 24, 26 are in an over-center position and can move no closer to the fixed handle 12 because the protrusion 33 presses against the compound link 22 at the end 23.

As in the prior art over-center pliers, the jaws 13, 17 cannot be pried apart from the locked position by use of force which pulls or pushes on the jaws 13, 17, as separation of the jaws is prevented by the over-center condition of the pins 24, 26. However, the jaws 13, 17 in accordance with the invention, are readily separated by applying a force to the movable handle 19 in a direction which moves the movable handle 19 away from the fixed handle 12.

Figure 4:
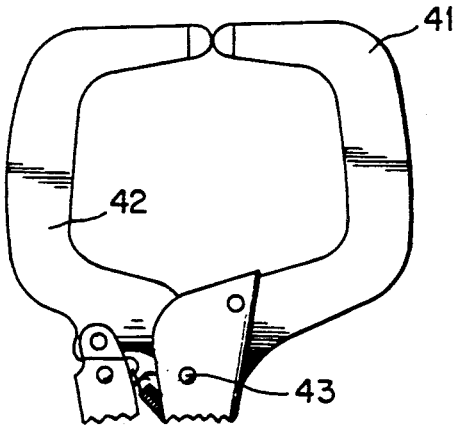
FIG. 4 is a side view of another embodiment of the invention.
Figure 5:
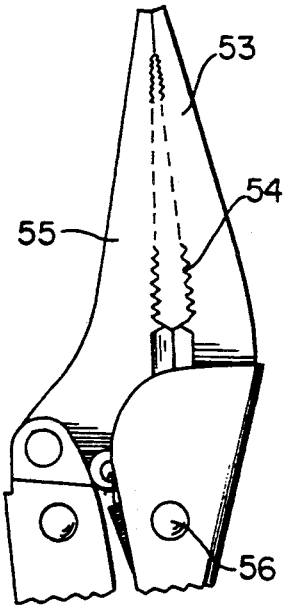
FIG. 5 is a side view of yet another embodiment o the invention.

FIG. 4 illustrates the arms of a toggle-locking C-clamp wherein a fixed clamp member 41 is shown cooperating with a movable clamp member 42, which pivots about the pin 43. FIG. 5 illustrates the head portion of a toggle-locking long nose plier, wherein fixed jaw 53 with serrated teeth 54 cooperates with a movable jaw 55, which rotates about the pivot pin 56. The mechanism described above, with reference to FIGS. 1-3 can be applied to such tools to provide quick and easy opening of the jaws. However, it should be understood that the compound toggle link in accordance with the invention is not limited to the over-center type tools illustrated in the application here.

It should be further understood that whereas the specification above describes an "over-center" condition of the pivot pins 24, 26, which maintains the jaws in a locked position, "over-center" should also be construed to include a pin arrangement which lines the pins up on "dead center," that is, in a straight line. Basically, any configuration of pivot pins and stops, for example, the stop 33, which places the mechanism in a locked position when the jaws are closed or grasping a workpiece, can be considered an over-center mechanism when force applied directly to the jaws to separate the jaws is not effective in moving the jaws. The jaws can only be moved by forces acting on the links of the mechanism.

It will thus be seen that the objects set forth, among those made apparent from the preceding description, are efficiently attained and, since certain changes may be made in the above constructions without departing from the spirit and scope of the invention, it is intended that all matter contained shall be interpreted as illustrative and not in a limiting sense.

It is also to be understood that the following claims are intended to cover all of the generic and specific features of the invention herein described, and all statements of the scope of the invention which, as a matter of language might be said to fall therebetween.

What is claimed:

1. A plier-type, toggle-locking, hand tool comprising:

a fixed handle with adjusting means at one end and a fixed jaw member at the other end;

a movable jaw pivotably mounted at a first pivot point on the fixed handle, the movable jaw being adapted to cooperate with the fixed jaw to hold a workpiece;

a movable handle pivotably connected at a second pivot point to the movable jaw, said movable handle cooperating with the fixed handle in opening and closing the jaws;

a compound link having first and second ends, said compound link pivotably mounted at said first end and by means of a third pivot point to the movable handle, said third pivot point positioned away from said second pivot point;

a toggle member having third and fourth ends, said toggle member pivotably mounted to the compound link at said third end by means of a fourth pivot point and engaged with said adjusting means of the fixed handle at said fourth end, said second end of the compound link extends substantially linearly beyond said fourth pivot point to define an engaging area, said fixed handle with said fixed jaw, said movable jaw and movable handle are shiftable from locked to unlocked position and vice versa, whereby in said locked position said third and fourth pivot points are in over-center position and prevented from moving closer to said fixed handle since at least a part of said toggle member presses against said engaging area of said second end of said compound link.

2. The hand tool as claimed in claim 1, further comprising a tensioning means extending from an intermediate point of the fixed handle to holding means, said holding means being on the movable jaw.

3. The hand tool as claimed in claim 2, wherein the tensioning means is a spring and said holding means is an opening for securing one end of the spring therein.

4. The hand tool as claimed in claim 1, wherein the jaw members are at least one of curved jaws, straight jaws, long nose jaws, C-clamps, C-clamps with swivel pads, and hole punch members.

5. The hand tool as claimed in claim 1, wherein the adjusting means comprises a threaded aperture, a screw engaged in the threaded aperture and a knob at the end of the screw for adjusting the position of said screw in said aperture.

6. The hand tool as claimed in claim 1, wherein the ratio of the length of the movable handle to the distance between said second pivot point for the movable handle and said third pivot point for the compound link is from about 4 to about 16.

7. A hand tool as claimed in claim 6, wherein said ratio is from about 6 to about 10.

8. The hand tool as claimed in claim 1, wherein said toggle member includes a projection acting as a stop to limit closing together of said handles.

9. The hand tool as claimed claim 8, wherein the compound link and the projection on the toggle link make contact when the hand tool is in the closed position.

10. The hand tool as claimed in claim 1, wherein the jaw members are arcuate with serrated teeth.

11. The hand tool as claimed in claim 1, wherein the jaw members are long nose pliers with serrated teeth.

12. A hand tool as claimed in claim 1, wherein in said locked position, said second and third pivot points, said third and fourth ends of the toggle are positioned substantially in a straight line.

* * * * *